US006082281A

United States Patent [19]

Root et al.

[11] Patent Number: 6,082,281

[45] Date of Patent: Jul. 4, 2000

[54] AUTOMATIC PILLOW SHAM SEWING MACHINE

[75] Inventors: Stephen J. Root; Kenneth Herring, both of Greenville; William Rogers, Belton, all of S.C.; Kirk Yedinak, Morven, N.C.; Charles Smith, Pelzer; Furman E. Burgess, Easley, both of S.C.

[73] Assignee: Diversified Systems, Inc., Greenville, S.C.

[21] Appl. No.: 09/185,444

[22] Filed: Oct. 26, 1998

Related U.S. Application Data

[63] Continuation of application No. 08/829,836, Apr. 1, 1997, which is a continuation-in-part of application No. 08/652,110, May 23, 1996, abandoned.

[51] Int. Cl.[7] ..... D05B 21/00

[52] U.S. Cl. ..... 112/475.03; 112/470.03; 112/470.07; 112/470.13; 112/475.07; 271/227

[58] Field of Search ..... 112/470.03, 470.06, 112/470.07, 470.12, 470.13, 470.36, 475.02, 475.03, 475.07, 475.08, 304, 306, 314; 271/176, 227

[56] References Cited

U.S. PATENT DOCUMENTS

| | | | |
|---|---|---|---|
| 3,477,397 | 11/1969 | Hawley | 112/2 |
| 4,273,059 | 6/1981 | Kamal | 112/470.13 |
| 4,434,731 | 3/1984 | Beisler | 112/470.13 |
| 4,512,269 | 4/1985 | Bowditch | 112/304 X |
| 4,590,873 | 5/1986 | Ulmen | 112/470.13 |
| 4,601,249 | 7/1986 | Frye | 112/470.13 |
| 4,624,198 | 11/1986 | Beam et al. | 112/10 |
| 4,685,408 | 8/1987 | Frye | 112/470.13 X |
| 4,865,309 | 9/1989 | Beasock et al. | 112/470.03 X |
| 4,893,574 | 1/1990 | O'Neal | 112/475.08 X |
| 5,018,462 | 5/1991 | Brocklehurst | 112/470.07 |
| 5,226,378 | 7/1993 | Suzuki | 112/304 X |
| 5,333,561 | 8/1994 | Katou | 112/470.13 |
| 5,816,177 | 10/1998 | Brocklehurst | 112/470.05 |

*Primary Examiner*—Peter Nerbun
*Attorney, Agent, or Firm*—Henry S. Jaudon; Cort Flint

[57] ABSTRACT

An arrangement of sewing successive edges of material which extend in two directions. The arrangement comprises a stationary sewing table having a prescribed sewing area. The sewing table supports a carriage. A sewing machine is supported by the carriage. Drives are provided for the carriage and the sewing machine and are operative to move the carriage selectively in the X and Y directions while operating the sewing machine to sew. A material feeding assembly having an independent drive is provided to feed material into the sewing area and to maintain the fed material in the sewing area in a flat fixed position for a prescribed period of time. A control operates to actuate the feeding assembly to position the material, to actuate the sewing machine to sew and to actuate the carriage carrying the sewing machine to move in the X and Y directions about the sewing area forming automatically a folded fabric having all edges stitched.

12 Claims, 8 Drawing Sheets

COMPUTER
PC 486
A
B
C
D
Y
F
S
6
6
14
16
18
22
24
26
30
36
39
41
42
50
52
54
55
58
66
70
72
73
74
78
80
82
86
88
98
100
102
106

COMPUTER
PC 486
Y
F
S

AUTOMATIC PILLOW SHAM SEWING MACHINE

BACKGROUND OF THE INVENTION

This application is a continuation of U.S. Ser. No. 08/829,836 filed Apr. 1, 1997 which is a continuation in part of previously filed application U.S. Ser. No. 652,110, filed May 23, 1996, now abandoned.

The present invention is directed to a method and apparatus for automatically manufacturing flat textile products and more particularly relates to a method and apparatus for flanging pillow shams.

Pillow shams of conventional construction are well known comprising a rectangular bag or case having four closed sides and a longitudinal opening formed along one side at approximately its center. A flanging operation consists of sewing at a certain distance from the edge of the case and sewing all the way around the case to form a flanged pillow sham. The flange may consist of two spaced parallel seams.

Normally, pillow shams are sold in sets which include two pillow shams and a matching bedspread or comforter. The spread or comforter is produced with automated machinery in a process which requires very little time. It is stated, the process for forming and flanging pillow shams is time consuming. The difference in time between these processes creates production and cost problems such as hugh overstocks of spreads or comforters awaiting pillow shams or disproportional members of personnel. Normally stitching, which is slightly spaced from the edges, secures a flat folded fabric in the appropriate configuration forming a pillow sham.

Conventional apparatus and methods comprise a stationary sewing machine and operator. A folded flat fabric is positioned for sewing along one edge. After sewing, the fabric is turned and a second edge is sewn. This process is repeated until all four edges are stitched.

There have been many efforts to automate or to partially automate sewing apparatus producing specific textile articles. A representative arrangement is shown in U.S. Pat. No. 4,893,574, i.e. an automated pillow case apparatus. Here, belts fold a fabric and present it to a stationary sewing head. The fabric is moved past the sewing head. Another related arrangement is shown in U.S. Pat. No. 4,601,249. Here, a device for sewing wash cloths or towels is disclosed. It includes a fabric feed which controls and moves the fabric in X and Y directions relative the sewing machine. The sewing machine pivots to sew along both the X and Y axis. U.S. Pat. No. 4,434,731 shows another automated arrangement in which the fabric is controlled and moved relative to the sewing machine.

It is the intent of the instant invention to provide a device which automatically sews pillow shams.

Another object of the invention is to provide a method of producing pillow shams at a markedly increased rate and reduced cost.

Another object of the invention is to provide apparatus for stitching a stationary flat fabric in the X and Y directions.

Another object of the invention is to provide apparatus for stitching designs over selected areas of flat fabrics.

Another object of the invention is to provide apparatus capable of moving a sewing machine through coordinated X-Y axes to produce stitched designs.

Another object of the invention is the provision of a device capable of automatically feeding a flat fabric, of automatically tensioning the fabric in a sewing position, and of automatically ejecting the sewn product.

Another object of the invention is the provision of a device capable of automatically centering a folded flat fabric prior to tensioning for sewing.

Another object of the invention is the provision of a device capable of centering and feeding a folded flat fabric into a sewing area, tensioning the fabric and sewing the fabric into a pillow sham.

Another object of the invention is to substantially increase the rate of production for forming spreads, comforters, pillow shams, and other like articles.

SUMMARY OF THE INVENTION

The instant invention is directed to a method of forming and flanging pillow shams which includes the steps of feeding a flat folded fabric having four edges into a sewing area while gripping the opposed edges of the fabric during delivery into the sewing area, tensioning the gripped fabric in a first direction and automatically sewing along but spaced from, all edges of the fabric to both form and flange a pillow sham and removing the formed pillow sham from the sewing area.

The method includes providing spaced pairs of superimposed rotatable belts for feeding, gripping opposed edges and tensioning the folded fabric. The method also includes causing the spaced pairs of belts to move transversely away from each other in the sewing area to tension the folded fabric.

The method includes measuring the length of the folded fabric during insertion into the sewing area and causing the spaced pairs of belts to be automatically moved to move the fabric to a position in which it is centered in the sewing area.

The method also includes providing a sewing machine to be moveable in X and Y directions either individually or coordinated and controlling the sewing machine to move along the X and Y directions during sewing of the edges of the folded fabric and in X, Y coordinated directions to sew design patterns onto the fabric.

The method includes providing a movable sewing machine for sewing a fabric, providing a home position for the sewing machine when not sewing, and automatically moving the sewing machine to the home position upon an interruption of sewing.

The method also includes providing a programmed control having a plurality of fabric support belts which are adapted to support the material across its width during feeding. The material handling assembly includes a positioning and tensioning section which includes vertically arranged and longitudinally spaced pairs of belts. The belts are operative to grip opposite edges of the material as they move it into the sewing area and to center the material for sewing within the sewing area. The belt pairs are controlled to be intermittently rotatable to position the material in the sewing area, to retain and tension the material in the sewing area and to remove the material from the sewing area.

An apparatus for forming pillow shams having a belt support structure is carried by a sewing table. The belt support structure includes a pair of guide plates between which the belt pairs travel. The support structure includes a sensor which signals sequentially a control to move the fabric into a sewing area; to position the fabric within a sewing area; to actuate the sewing machine and to control the sewing machine to move in the sewing area along each edge of the fabric; to deactivate the sewing machine upon completion of sewing and to actuate the fabric control apparatus to discharge the sewn fabric.

The invention is also directed to an arrangement for automatically positioning flat material for sewing and for forming that material into a sewn article. The arrangement includes a sewing table having a sewing area, a material handling assembly carried by the sewing table which is selectively operable to position and tension the material in the sewing area. A sewing machine, mounted on a carriage assembly, is also provided.

A control assembly is provided. The control assembly is operative to actuate the material handling assembly to position and tension the flat material in the sewing area, to actuate the carriage assembly to move the sewing machine about and/or through the sewing area and to actuate the sewing machine to sew during movement through the sewing area.

The arrangement includes;

A material feeding assembly, which is operative to feed the material into the sewing area, to center the material within the sewing area, and to maintain the material in a stationary tensioned condition for a prescribed time.

A control system is associated with the feeding assembly and includes sensors which measure the length of the material during feeding. The control system actuates the feeding assembly to position the material with its longitudinal center arranged centrally in the sewing area in response to the measured length.

The arrangement also includes a tensioning apparatus which urges the plates together or toward each other. The plates then act to position the belts to grip material. The support structure includes a guide plate mounting structure which mounts the guide plates for transverse movement. Drives are connected with opposed ends of the guide plates. The drives are operative to selectively move the guide plates transversely providing for selective tensioning of the material in sewing area.

A mounting platform is mounted for movement in the X direction across the sewing table. The mounting platform is carried by a mounting table which is mounted for movement in the Y direction across the sewing table. The sewing machine is carried by the mounting platform. Drive members are associated with the mounting table and the mounting plate to independently drive them sequentially or simultaneously in the X and Y directions. The drive members comprise drive motors which are controlled by a program control.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
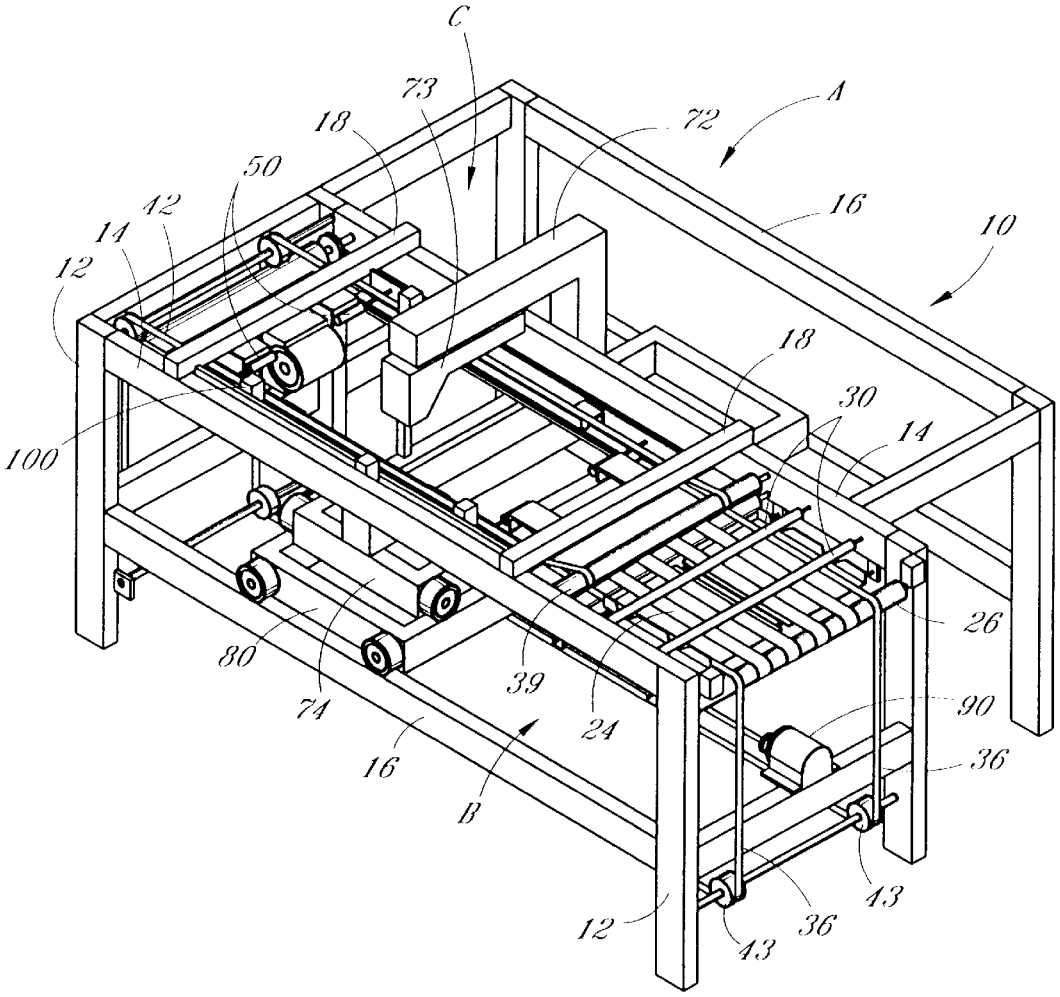
FIG. 1 is a perspective view of the sewing arrangement of the invention.
Figure 2:
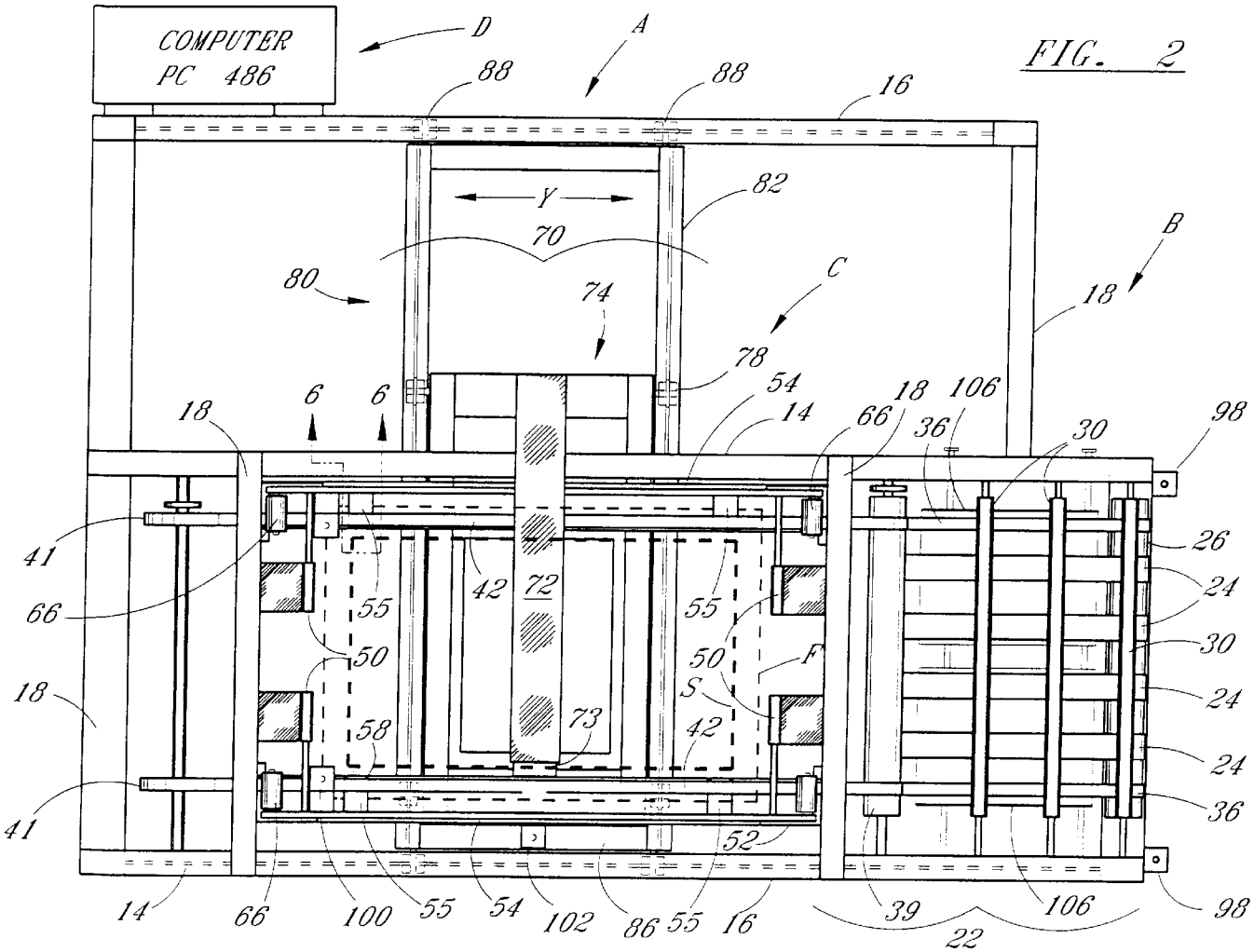
FIG. 2 is a top view of the sewing arrangement of the invention.
Figure 3:
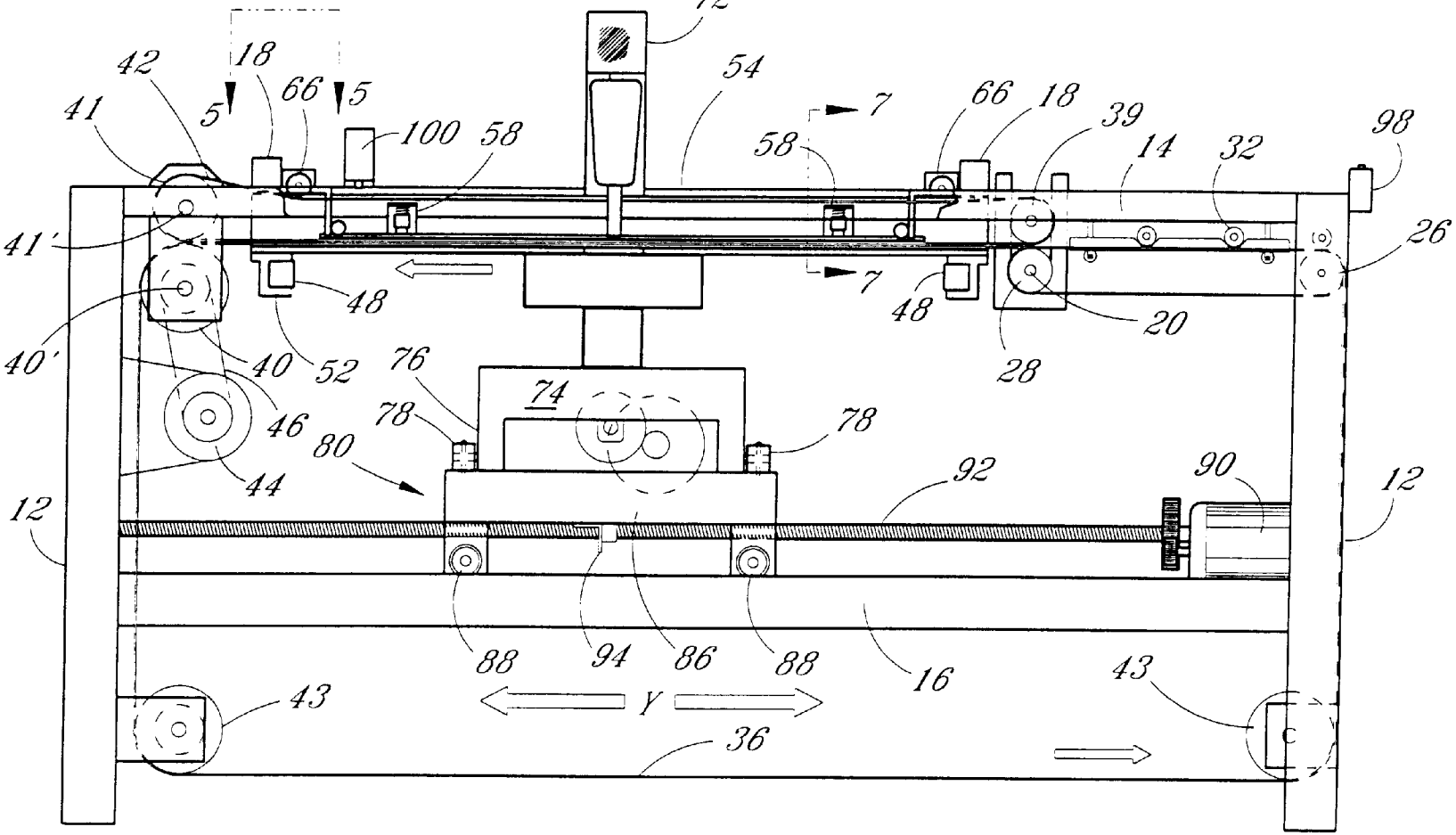
FIG. 3 is a side view of the sewing arrangement shown in FIG. 2.

Referring now to the drawings, the invention will now be described in more detail. FIGS. 1–3 show the sewing arrangement which comprises a support system A, a feed assembly B, a sewing assembly C and control system D.

Support system A includes frame 10 having vertical support rails 12 which support spaced top horizontal longitudinal beams 14 and lower horizontal longitudinal beams 16. A plurality of upper transverse rails 18 interconnect with upper beams 14 to form an upper support structure. Lower transverse rails 18 intersect with lower beams 16 to form a stable support system.

Feed assembly B is arranged along upper beams 14 and extends along the entire length of support assembly A. Feed assembly B includes a feed conveyor section 22 which includes a plurality of support belts 24 carried by idler rolls 26 and 28 which are carried by shafts 20. A plurality of press rolls 30 are supported by support belts 24 and are retained in position by slots formed in upper beams 14. Press rolls 30 act to maintain a folded fabric in position on belts 24 during feeding.

A pair of lower feed belts 36 are arranged adjacent upper beams 14 and outside of support belts 24. Feed belts 36 pass over idler roll 26, between idler rolls 28, 39 and over drive rolls 40, the latter being carried by shaft 40'. The aforesaid rolls are all arranged along upper beams 14. Belts 36 pass downwardly from roll 40 to first idler rolls 43, beneath frame A in the vicinity of lower beams 16, to second idler rolls 43, and then back to idler roll 26.

Second rolls 39 and 41 are arranged vertically of first rolls 28 and 40. Second roll 39 which is slightly spaced from roll 28 is an idler roll while second roll 41, which is carried by shaft 41', is a drive roll. Drive roll 41 is driven by first roll 40. Second rolls 39 and 41 carry a pair of second feed belts 42 which are arranged vertically of lower feed belts 36.

Drive motor 44 is connected with shaft 40' through a suitable drive, such as a drive belt 46, to drive the support belts and the feed belts in a direction which will convey a flat folded fabric from right to left as viewed in FIGS. 1–3.

Figure 8:
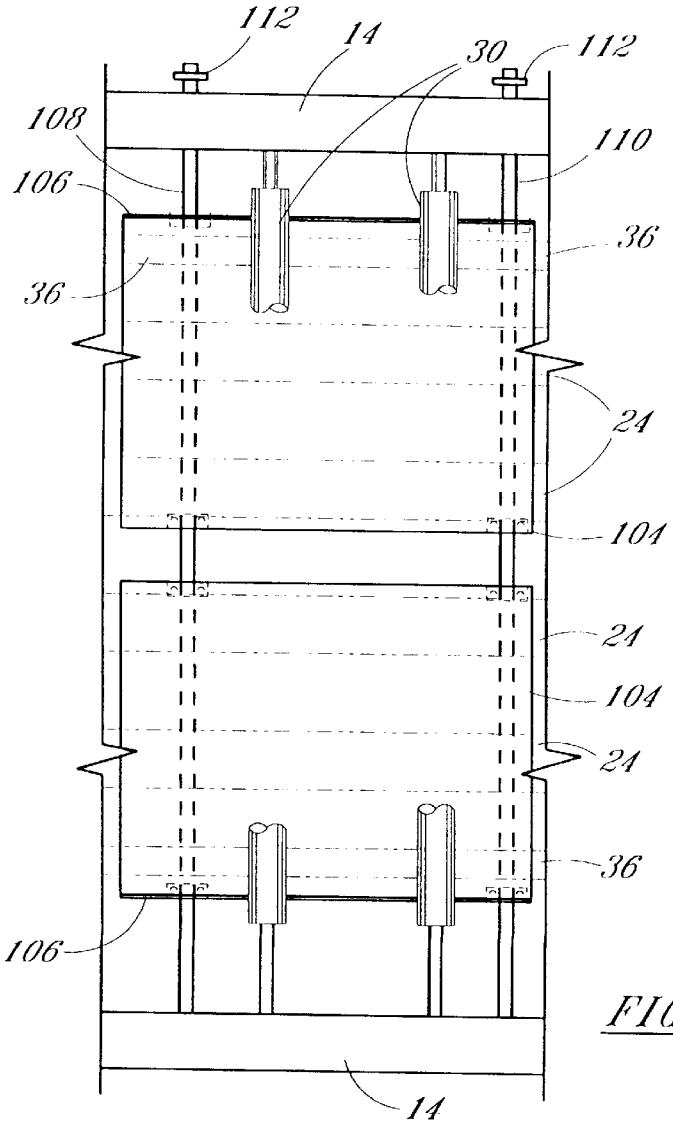
FIG. 8 is a sectional top view of the centering tray of the conveyor section.

A centering tray 104 as seen in FIGS. 2 and 8 is located beneath the supporting surface of belts 36 and 24 in the feed conveyor section 22. Centering tray 104 consists of two spaced sections, each carrying a vertically extending flange or ear 106.

Flanges or ears 106 extend above the plane of and are parallel with belts 24 and 36. Threaded supports 108, 110 carry the spaced sections of centering tray 104. By rotating knobs 112, supports 108, 110 move the spaced sections laterally toward or away from each other thus adjusting the position of flanges 106 relative to the longitudinal edges of belts 36. Flanges 106 function to engage the lateral edges of a folded fabric placed in conveyor section 22 to align the fabric relative to the longitudinal direction of feed assembly B.

Transverse rails 18 carry support slides 48, as best seen in FIG. 3. Each slide 48 supports a pair of opposed slide brackets 52. A pair of support rails 54 are connected at their ends with slide brackets 52 for movement along slides 48. A pair of pistons 50 are arranged between and are connected also with opposed ends of support rails 54. Support rails 54 are arranged parallel with beams 14 and are located between rails 18 and beams 14. Pistons 50 are controlled by control system D as will be discussed later. It is noted that pistons 50 could be solenoids.

As best shown in FIGS. 2, 5, 6, and 7, at least a pair of L shaped angles 55 are carried by each of rails 54. Each angle 55 includes vertical arm 56 and horizontal arm 58. A bracket 60 is attached with each vertical arm 56. Each bracket 60 carries a piston 62 which is urged downwardly toward arm 58 by a suitable device, such as a spring 67. It is noted that piston 62 could alternatively be controlled by a solenoid.

The horizontal arm 58 is arranged to extend along the entire length of rail 54. Its upper surface is formed with a shallow groove 58' which is adapted to receive a run of belt 36. Located above groove 58' is bar 64 which is carried by the end of piston 62. Bar 64 co-extends with arm 58 and is formed with a groove 64' formed in its lower face. Groove 64' is arranged to overlie groove 58'. Grooves 58', 64' are resiliently urged toward each other with sufficient force to cause the opposed faces of belts 36 and 42 to engage with each other sufficiently to grip a flat fabric. The number of L shaped angles attached to each rail 54 may vary, it only being required that belts 42 and 36 be retained in even resilient contact sufficient to hold a flat folded fabric stably in position during sewing.

Rails 54 also carry vertically adjustable idler rollers 66 along their upper edges adjacent their opposite ends. Rollers 66 act to adjust the tension on feed belts 42 and to guide the feed belts downwardly from rollers 39 and 40 to form a good wrap about these rollers.

Upper feed belts 42, which are vertically aligned with feed belts 36, pass around second roll 39 and drive roll 41 and beneath idler rolls 66. Along its lower run belts 42 are guided in grooves 64' beneath bars 64 and in contact with the upper surface of belts 36 as they travel in grooves 58' of arm 58. Springs 62 are adjustably mounted with bracket 60 to selectively determine the pressure at which belts 42 engage with belts 36 in sewing area 70.

Figure 4:
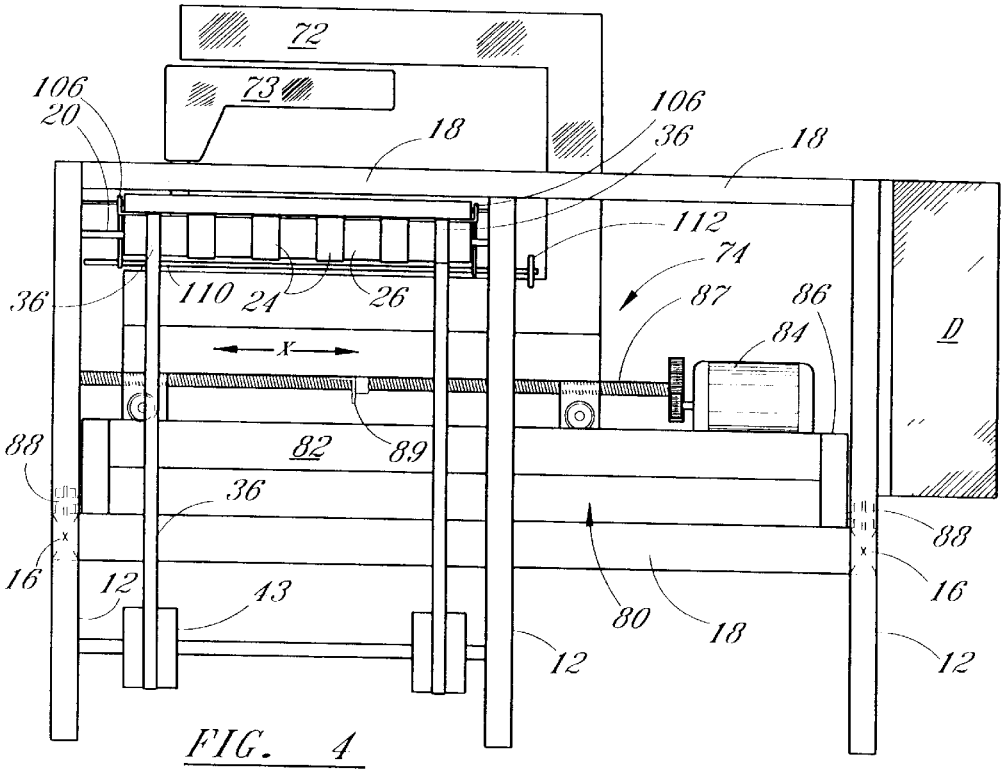
FIG. 4 is an end view of the sewing arrangement shown in FIG. 2.
Figure 5:
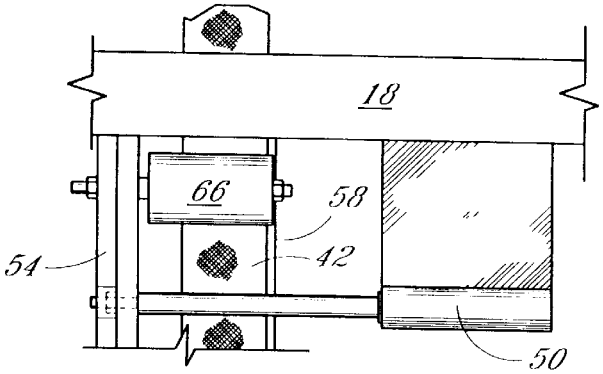
FIG. 5 is an exploded cut away view of FIG. 3 taken between line 5.
Figure 7:
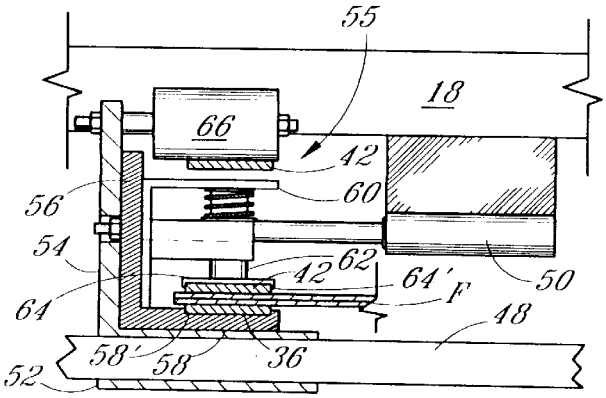
FIG. 7 is an exploded cut away view taken along line 7—7 of FIG. 3.
Figure 6:
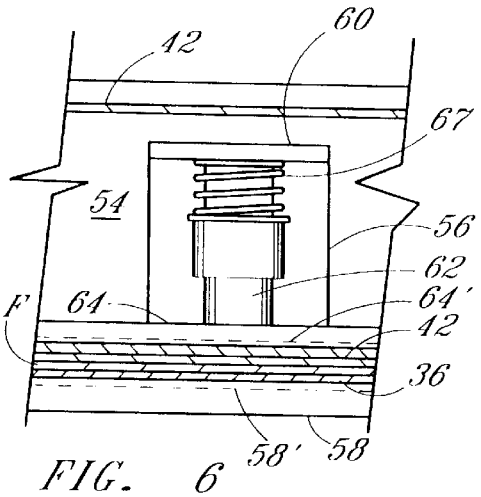
FIG. 6 is an exploded cut away view of the belt guide and pressure device.

Sewing assembly C includes a sewing machine 72, which may be any suitable commercially available brand, mounted on mounting platform 74. As shown in FIGS. 2, 3, and 4, the arm of sewing machine 72 is of sufficient length to extend entirely across the width of sewing area 70. Mounting platform 74 includes rollers 78 which are arranged to rest on transverse rails 82 which are carried by table 80. Table 80 includes rollers 88 which rest on lower longitudinal beams 16 and are adapted to carry the table longitudinally of frame 10. A motor 84 is carried by table 80 and is drivingly connected with platform 74 by drive screw 87 and nut 89. Rotation of screw 87 moves platform 74 along rails 82 transversely of sewing area 70 in the space between spaced belt pairs 36, 42, i.e. in the X direction.

Table 80 includes longitudinal beams 86 which connect with rails 82 and carry rollers 88. Motor 90 through drive screw 92 and nut 94 connects with and is operative to drive table 80 along beams 16 longitudinally of the support system, i.e. in the Y direction.

As best shown in FIGS. 2 and 3, rails 82 of table 80 are sufficiently long to allow platform 74 to move sewing head 73 of sewing machine 72 between spaced rails 54 completely across the width of sewing area 70. The drawings also show lower beams 16 to be sufficiently long to allow table 80 to move sewing head 73 along the length of rails 54 completely across the length of sewing area 70.

Preferably the start position is as shown in FIG. 2, with sewing machine 72 positioned to be at substantially the center of sewing area 70. In this position, sewing head 73 is positioned across the sewing area at an intermediate point thereof. This location is approximately the point where the ends of the folded fabric overlap in a pillow sham. Of course any position along the periphery of sewing area 70 could be selected and would be suitable for the start position.

Control D which is a programmed computer i.e. IBM 486 PC, is connected with motors 84 and 90 and to sewing machine 72 to selectively control the operation and movement of sewing machine 72. Control D is also connected with motor 44 and pistons 50 to selectively control feed assembly B.

Depending upon the program given the computer of Control D, motors 84 and 90 are controlled independently to move sewing machine 72 through selected distances in the X or Y directions or the motors are controlled simultaneously to move sewing machine 72 in coordinated XY directions which are selected in accordance with a desired pattern.

In a standard flanging operation, control D is programmed to move the sewing machine in successive X-Y directions. When it is desired that the flange also contain a pattern, control D is programmed to command a combination of successive X-Y movements and coordinated X-Y movements for the sewing machine. When only a stitch pattern is desired control D is programmed to command coordinated X-Y movement of the sewing machine.

There is an electronic sensor or photo sensor 100 located along the far edge of sewing area 70 which is connected with Control D. There is also a start stop switch 98 located adjacent the feed conveyor section 22. Another sensor could be arranged at the start point as indicated at 102. This sensor is optional.

Figure 9:
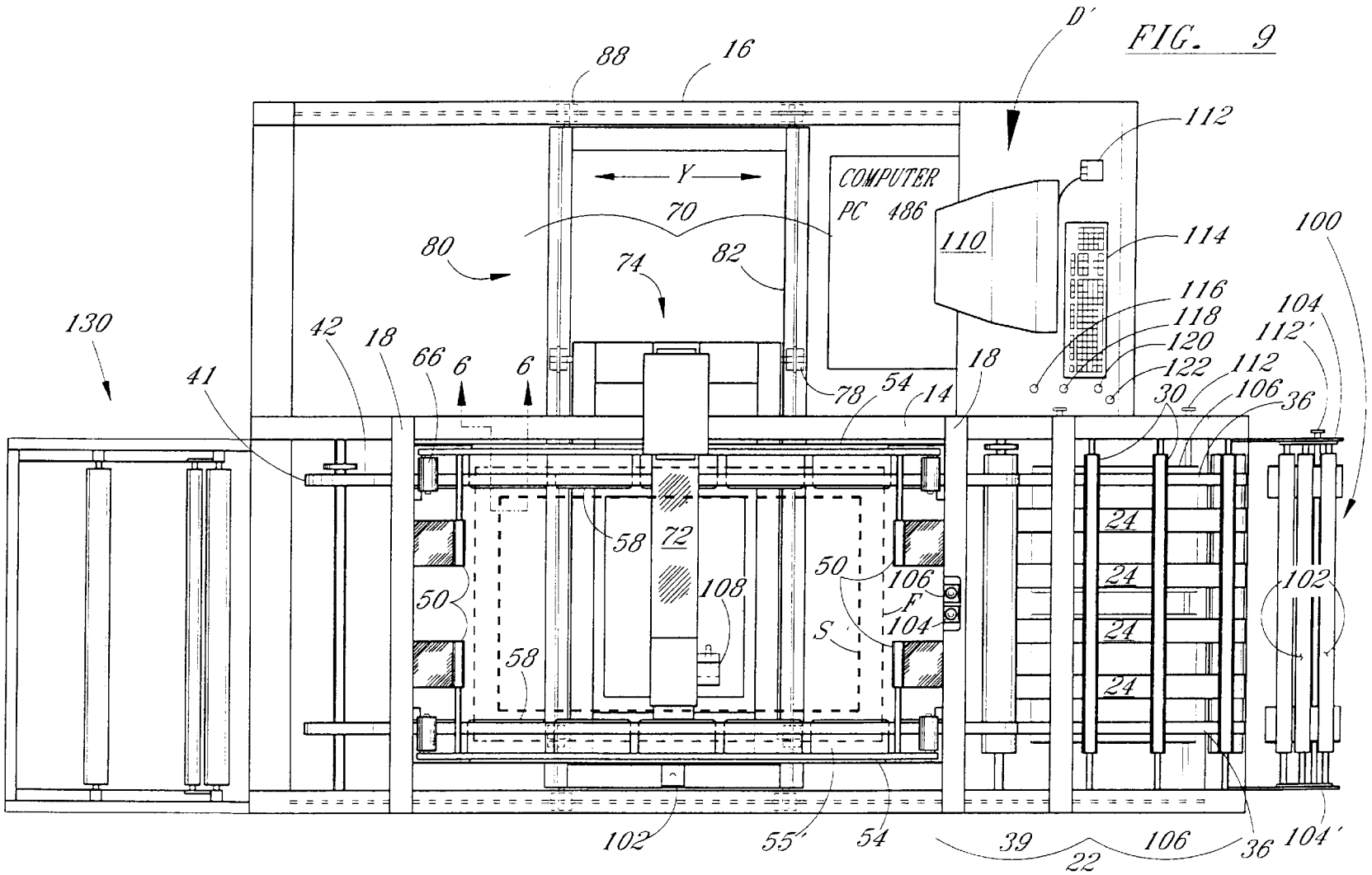
FIG. 9 is a top view of a second embodiment of the sewing arrangement of the invention.
Figure 10:
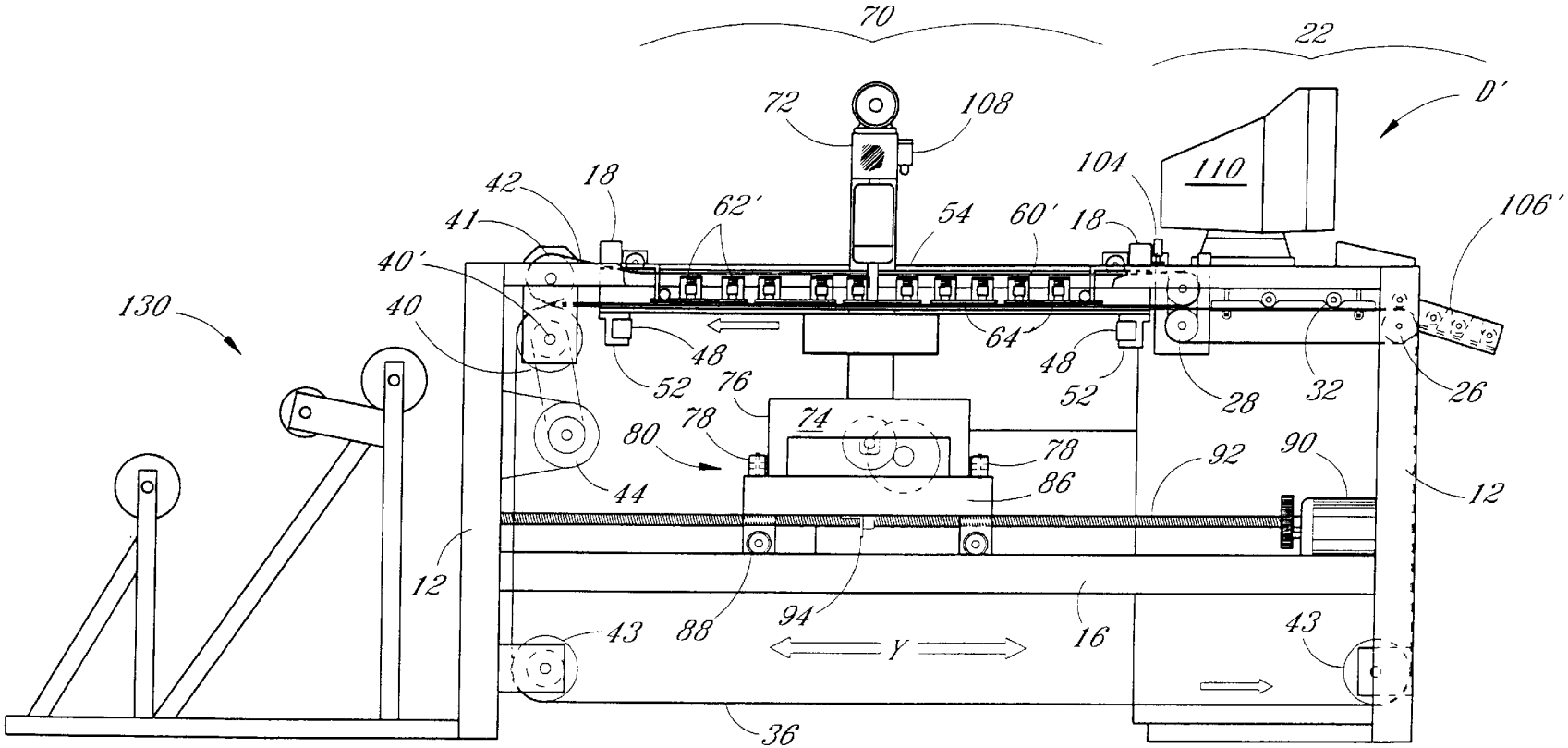
FIG. 10 is a side view of the embodiment shown in FIG. 9.

A second embodiment of the invention is shown in FIGS. 9 and 10. This arrangement utilizes substantially all of the components of the arrangement shown in FIGS. 1–8 and like members are identified with like numerals.

Turning now to conveyor feed section 22 as comprised in the arrangement of FIGS. 9 and 10. An extended support section 100 is arranged forwardly of belts 24 and 36. It includes support idler rollers 102 which act to support the folded product as its forward end is drawn by feed belts 36 toward and into sewing area 70. Extended support section 100 also includes an extended centering tray 104' which is similar to centering tray 104, previously described, and includes vertically extending flanges 106' which are controlled by knob 112'. The extended centering tray 104' acts in conjunction with centering tray 104 to align or center the fabric along a longer portion of its length during initial feeding and therefore improves the degree of alignment achieved in sewing area 70.

Sewing area 70, of the arrangement shown in FIGS. 10 and 11, again is substantially as described in FIGS. 1 and 2. Primarily, bar 64 is divided into a plurality of sections or bars 64'. There are five bars 64', preferably about 8" each, associated with each horizontal arm 58. There are two pistons 62' per bar 64', one at each end, which act to force the bars downwardly toward arm 58 to press belts 36, 42 at five independent locations into gripping contact.

Sewing machine 72 is provided with an optical stitch sensor 108 which acts to monitor each stitch. Sensor 108 is operative to detect a mis-stitch which may be due to malfunction or a broken thread and to signal such fact to control D'.

Sewing machine 72 has a home position indicated generally at 102 in FIG. 9. This is the position to which the sewing machine is brought upon completion of a sewing cycle and from which it begins a new sewing cycle.

Control D' is programmed to automatically move, preferable by the most direct route, sewing machine 72 to home position 102 upon an indication of a thread break by sensor 108. An operator acts to re-thread the machine and when finished actuates the re-set button of Control D'. Control D' then automatically returns sewing machine 72 to the point where sensor 108 sensed the break. Upon re-positioning the sewing machine, control D' actuates sewing and the partially completed sewing pattern is completed.

The manner in which the fabric is positioned to be sewn is controlled by a pair of optical sensors 104, 106 each connected with control D'. Sensors 104, 106 are mounted on rail 18 adjacent the entry into sewing area 70. Sensor 104 senses the forward end of the fabric moving into the sewing section and signals control D'. As belts 36, 42 draw the fabric into the sewing area and past rail 18 sensor 106 senses the end of the fabric and signals control D'. Control D' using these spaced signals computes the exact length of the fabric and controls motor 44 to precisely longitudinally center the fabric within sewing 70. This arrangement is extremely desirable because, in many instances, fabric blanks are not cut exact and it enables the flange stitching to always be symmetrically centered.

Control D' now controls motors 84 and 90 to move sewing machine 72 in the desired manner. Control D' also activates the sewing machine to sew.

Control D', comprises a PC 486 computer to include a screen 110, a mouse 112 and key board 114. It also includes re-set switch 116, thread break switch 118 and ready switch 120. A stop switch 122 is also provided.

The computer is capable of storing several sewing patterns while utilizing a single pattern. Mouse 112 is operative to place selected of the patterns in position to direct the operation of the sewing machine.

Ready switch 120 simply activates the device. Thread break switch 118 operates to move the sewing machine to home position 102 when desired. Reset switch 116 acts to move the sewing machine to an intermediate point in a pattern where sewing stopped due to malfunction. Stop switch 122 stops the operation.

A support or guide assembly 130 is attached adjacent to the rear edge of the support frame. Guide assembly 130 comprises a plurality of spaced rollers arranged at a descending angle. The guide assembly acts to assist is guiding the sewn pillow sham during its ejection from the sewing area.

In operation, the sewing machine 72 is positioned as shown in FIGS. 1, 2, 9 and 10 in the start or home position. An operator actuates the start switch 98 or ready switch 120 and places a flat folded piece of material into feed section 22 in position to be supported by belts 24 and 36. Control D or D' operates to activate motor 44 to circulate belts 24, 36, and 42. As belts 24 and 36 move the flat material through feed section 22 flanges 106 of centering tray 104 align the fabric as it is moved into sewing area 70. As it enters sewing area 70 the opposed edges of the fabric are engaged in the nip created between vertically spaced belt pairs 36 and 42 in the vicinity of rolls 28 and 39. Motor 44 continues to circulate belts 36 and 42 until the entire fabric is drawn into sewing area 70 with its opposed edges engaged between and gripped by belts 36, 42 along their entire length. In the arrangement of FIG. 1 and 2 when the forward edge reaches the position to be sensed by sensor 100, motor 44 is deactivated by control D. In the arrangement of FIGS. 9 and 10, control D' computes the size of the fabric and generates a positioning signal which controls motor 44 to position it centrally of the sewing area. At this point, the fabric is positioned within sewing area 70 as indicated by the dotted line F. The dotted line S indicates the general line along which the fabric is sewn. The area between lines F and S comprises the flange area of the pillow sham.

Pistons 50 are now activated to move or urge rails 54 carrying belts 36 and 42 outwardly. As belts 36 and 42 are gripping opposed edges of the fabric, this action places the positioned fabric under tension, and in condition to be sewn.

Assuming it is desired that the device form the flange on a pillow sham, Control D or D' now is programmed to activate sewing machine 72 along with motor 90 to move table 80 and sewing machine 72 in the Y direction. After sewing machine 72 has moved a prescribed distance, Control D or D' deactivates motor 90 and activates motor 84 which moves platform 74 and the sewing machine in the X direction. Again, after moving sewing machine 72 a prescribed distance, motor 84 is deactivated. It is noted that sewing head 73 of sewing machine 72 is now aligned with the opposite longitudinal side of sewing area 70 along the dotted lines. Motor 90 is again activated and the sewing machine and table 80 are moved in the Y direction but opposite the first direction of movement. Again, upon sewing machine 72 and table 80 moving a prescribed distance, motor 90 is deactivated. At this point sewing machine 72 has reached the opposite end of sewing area 70. Motor 84 is now reactivated to move sewing machine 72 and platform 74 in the X direction a prescribed distance to bring sewing machine 72 into alignment with the first longitudinal edge of fabric F. Again motor 84 is deactivated and motor 90 is again activated to move table 80 and sewing machine 72 in the Y direction until the sewing machine moves slightly past the start position. At this point, the sensor at home position 102 may or may not be used to cause Control D or D' to reverse the direction of drive of motor 90 and move the sewing machine back into the start position. Control D or D' now deactivates motor 90, sewing machine 72 and pistons 50 which allows rails 54 to move slightly toward each other to relieve the tension on the now sewn fabric. Motor 44 is activated to cause belts 36 and 42 to circulate and eject the sewn fabric through rollers 40, 41 and from the sewing assembly.

The sewing machine 72 is controlled to successively stitch along all four outer edges of the flat folded fabric while it is held under tension in the sewing area 70. By moving sewing machine 72 slightly past the start position, the sewn seam is locked at its beginning and ending points. This sewing arrangement is particularly useful for flanging and forming pillow shams in an automatic, efficient and fast manner.

Figure 12:
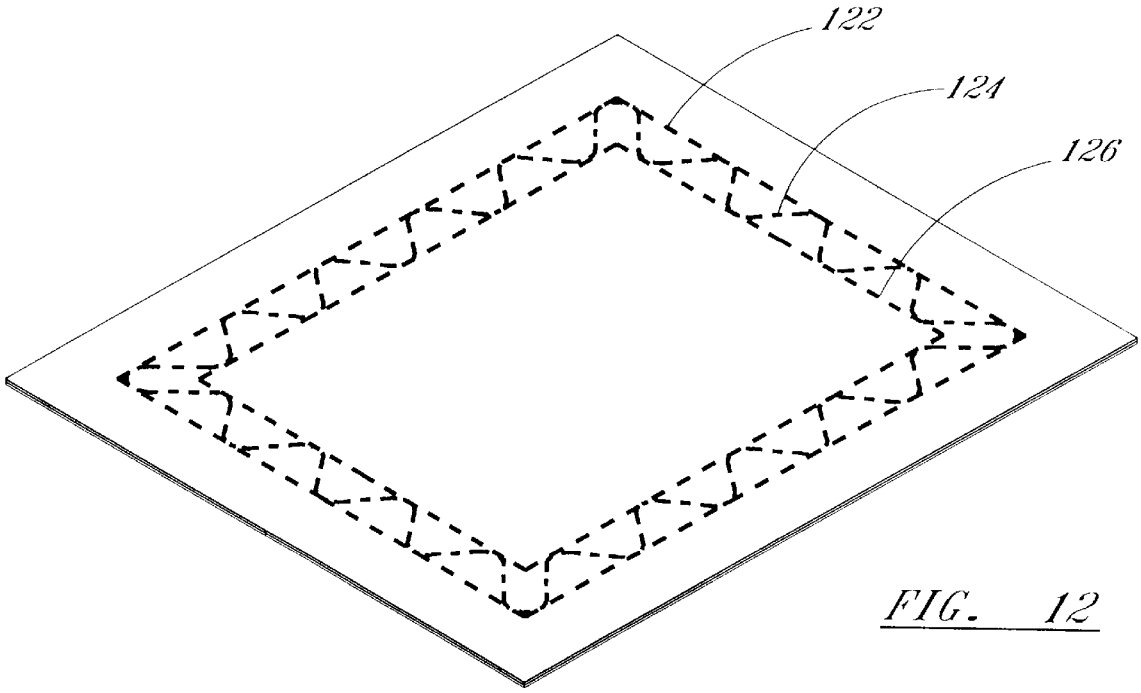
FIG. 12 is a top view of a pillow sham having a spaced pair of flange forming seams with a design stitched therebetween.

Turning now to FIG. 12, a pillow sham 114 is shown with its flange formed by a pair of spaced parallel stitches 122, 126 with a decorative stitch 124 formed therebetween. To form this pillow sham, control D or D' would be programmed to move sewing machine 72 through two of the before described flanging motions to form seams 122, 126. Control D or D' would then again control sewing machine 72 move around the pillow sham with a coordinated X-Y motion created by selective control of motors 84 and 90 to sew in the patterned seam 124.

Figure 11:
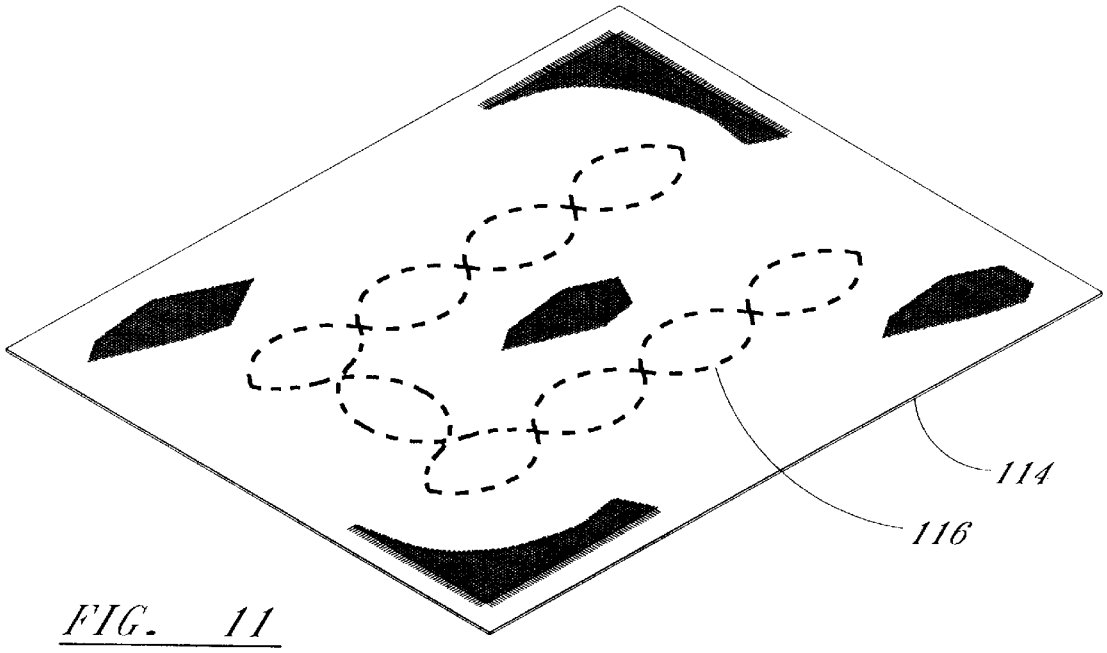
FIG. 11 is a top view of a flat fabric on which a design has been stitched.

It may be desired to sew a decorative pattern on the outer surface of the fabric forming the pillow sham or at least that portion forming the face of the pillow sham. FIG. 11 is illustrative of such a fabric identified as 114. The fabric in flat form would be introduced into the sewing area 70 and positioned for sewing as earlier described. Control D or D' would be programmed to control motors 84 and 90 to move sewing machine 72 only with a coordinated X-Y movement so that it would form seam 116 in the pattern shown or some other desired pattern. The fabric would then be folded and inserted into an assembly with a control programmed to flange a pillow sham.

It is noted that the sewing arrangement disclosed is not limited to decorating and flanging pillow shams, but could be used for stitching quilts, bedspreads, pet pads, comforters, and other like articles.

While a preferred embodiment of the invention has been described using specific terms, such description is for illustrative purposes only, and it is to be understood that changes and variations may be made without departing from the spirit or scope of the following claims.

What is claimed is:

1. A method of automatically forming a pillow sham comprising the steps of:

positioning a flat folded fabric having four edges for feeding into a sewing area;

sensing said flat folded fabric and generating a positioning signal;

feeding said flat folded fabric into said sewing area and centering said flat folded fabric within said sewing area in response to said positioning signal;

sewing along all edges of said flat folded fabric to convert said flat folded fabric into a pillow sham; and removing said pillow sham from said sewing area.

2. The method of claim 1 including providing a sewing machine and controlling relative movement of said sewing machine and said flat folded fabric along X and Y directions during sewing.

3. The method of claim 2 including providing a control responsive to said positioning signal, said control causing said flat folded fabric to be moved into and centered in said sewing area.

4. The method of claim 3 wherein said control acts to actuate and deactivate said sewing machine.

5. The method of claim 1 including the method of tensioning outwardly at least a portion of an edge of said flat folded fabric during sewing.

6. The method of claim 1 including providing a control, and a fabric gripping apparatus, said control being operative to sequentially actuate said fabric gripping apparatus to move said fabric into said sewing area, to position said fabric centrally of said sewing area, to actuate said sewing machine to sew along each edge of said flat folded fabric, to deactivate said sewing machine upon completion of sewing of said edges and to actuate fabric discharge apparatus to remove said fabric from said sewing area.

7. An arrangement for receiving, transporting, positioning and sewing flat material comprising:

a sewing table having a receiving area and a sewing area;

a material handling assembly carried by said sewing table, said material handling assembly being selectively operable to grip said material received in said receiving area to transport and position said material in said sewing area;

a sewing machine;

a sensing device operative to sense said flat material and produce a reference signal representing at least one dimension of said material;

a control, said control being operative to receive said reference signal from said sensing device, to actuate said material handling assembly to transport said material into said sewing area, to position said material centrally of said sewing area in response to said reference signal, and to actuate said sewing machine to sew along each edge of said flat material.

8. The arrangement of claim 7 including an edge tensioning apparatus for tensioning at least a portion of an edge of said fabric during sewing.

9. An arrangement for sewing along all edges of a flat material having four sides, the arrangement comprising:

a sewing table having a feed area and a sew area;

a sewing machine located in said sew area;

a sensing device located adjacent said feed area for sensing said material and generating a signal;

a material feeding assembly, said feeding assembly being operative to remove said material from said feed area, to move said material into said sew area and to position and material centrally of said sew area; and, a control system, said control system being operative to receive said signal, to control said feeding assembly to position said material centrally of said sew area in response to said signal, to actuate said sewing machine to sew said fabric edges in X and Y directions and to remove said material.

10. The arrangement of claim 9 whereby said feed area includes a centering tray, said centering tray acting to position said material for said feeding assembly.

11. The arrangement of claim 10 wherein said centering tray includes adjustable sides for handling different sized material.

12. The arrangement according to claim 9 wherein said sensing device is operative to produce said signal in response to at least the sensed length of said material.

* * * * *